United States Patent [19]

Larson

[11] Patent Number: 4,575,886

[45] Date of Patent: Mar. 18, 1986

[54] FIBEROUS WAVE-DAMPENING APPARATUS

[76] Inventor: Lynn D. Larson, 6051 Park Crest, Lincoln, Nebr. 68506

[21] Appl. No.: 339,906

[22] Filed: Jan. 18, 1982

[51] Int. Cl.[4] ..... A47C 27/08

[52] U.S. Cl. ..... 5/450; 5/451; 156/78; 156/145; 428/306.6; 428/308.4; 428/316.6

[58] Field of Search ..... 5/451, 480, 481, 450, 5/441, 452; 156/78, 145; 428/306.6, 308.6, 316.6

[56] References Cited

U.S. PATENT DOCUMENTS

| | | | |
|---|---|---|---|
| 2,800,165 | 7/1957 | Talatay et al. | 5/481 |
| 2,831,532 | 4/1958 | Kasper | 5/481 |
| 2,866,497 | 12/1958 | Struthers | 5/481 |
| 3,456,270 | 7/1969 | Weinstein et al. | 5/481 |
| 3,503,840 | 3/1970 | Parrish | 5/481 |
| 3,654,065 | 4/1972 | Dorogi | 5/481 |
| 3,691,569 | 9/1972 | Ikada | 5/481 |
| 3,874,980 | 4/1975 | Richards et al. | 428/316.6 |
| 4,192,031 | 3/1980 | Fogel | 5/481 X |
| 4,301,560 | 11/1981 | Fraige | 5/451 |
| 4,303,456 | 12/1981 | Schmuck et al. | 156/78 |
| 4,399,575 | 8/1983 | Hall | 5/451 |
| 4,462,128 | 7/1984 | Labianco | 5/450 |
| 4,467,485 | 8/1984 | Hall | 5/450 |
| 4,496,623 | 1/1985 | Fraige | 5/450 |

FOREIGN PATENT DOCUMENTS

| | | | |
|---|---|---|---|
| 59123 | 9/1982 | European Pat. Off. | 5/451 |
| WO80/01036 | 5/1980 | PCT Int'l Appl. | 5/451 |
| 2066060 | 7/1981 | United Kingdom | 5/451 |

*Primary Examiner*—Alexander Grosz

*Attorney, Agent, or Firm*—Zarley, McKee, Thomte, Voorhees & Sease

[57] ABSTRACT

An apparatus for dampening wave action in a waterbed is disclosed. The apparatus consists of a fibrous member bonded to a flexible foam member which is positioned inside a waterbed bladder. The coaction of the fiber and foam dampens waves generated in the water and also provides improved shape-retaining characterisitcs in the apparatus. The use of a large fibrous component allows water to be quickly evacuated from the apparatus and the use of a foam component provides flotation and spacial orientation of the apparatus within the waterbed bladder. A method for bonding the foam to the fibrous member is also disclosed.

3 Claims, 7 Drawing Figures

FIBEROUS WAVE-DAMPENING APPARATUS

BACKGROUND OF THE INVENTION

Waterbeds have, in recent years, come into widespread use throughout the country. A typical waterbed consists of a waterfilled bladder supported within a rigid frame. Although early users of waterbeds were primarily younger people attracted by the novelty and low cost of the apparatus, the use of waterbeds has now spread to a wider range of consumers. Perhaps the most important reason for the popularity of waterbeds is that waterbed mattresses provide uniform sleeping support and eliminate pressure points on which most of a person's weight rests when reclining on conventional sleeping surfaces. In addition, the co-action of the water and the waterbed bladder produces a floating sensation that many people find quite pleasant.

Waterbed manufacturers have been very innovative in providing improvements such as waterbed heaters, elevated frames, and improved bedding material which make waterbeds much more acceptable in the conventional bedding market. However, a major problem with waterbeds to date has been the wave motion set up in the water whenever a person reclines on the bed or changes positions on the bed. Generally, a series of transverse waves are created which are reflected by the lateral walls of the waterbed. As the waves strike the walls, an annoying slapping sound is produced and, because of the reflective action of the walls, the waves generally continue for several seconds before dampening out. A number of inventors have sought to improve the dampening action of waterbeds by providing various insert devices to break up the wave action of the water. Unfortunately, most of the inventions to date have been only modestly effective and tend to impair the sleeping characteristics which have drawn people into the waterbed market. Most prior art devices utilize some sort of baffle arrangement which must be attached to the surface of the waterbed bladder. The surface connection requires heat welding or other attachment means which slows production and increases the cost of the waterbed to the buying public. In addition, the surface attachment sometimes tends to disrupt the co-action of the water and the bladder which produces the floating sensation associated with waterbeds. The use of open-celled foams as a dampening means represents a slightly different approach to the problem. The absorbtion of water within the foam member tends to reduce the wave action of the water by breaking up the volume of the water into a number of interconnected cells. However, a problem with open-celled foam members has been that the foam tends to retain the water and thus, makes it difficult to drain the waterbed after it is initially set up. In addition, the use of thick open-celled members tends to impair the fluid "feel" of the water, causing the waterbed to act like a foam cushion rather than a fluid body.

For these reasons, it can be seen that a need exists for a waterbed dampening system which is easy to fabricate and produce and which will not interfere with the desirable sleeping characteristics of the waterbed. The device should not prevent the waterbed from being easily drained and should be compressible to facilitate folding and storage.

SUMMARY OF THE INVENTION

The wave-dampening apparatus of the present invention consists of a flexible fibrous member with a thin foam member attached to its upper surface. The dampening apparatus is placed within the bladder of a waterbed and co-acts with the water to produce wave dampening. The primary wave dampening is produced by the fibrous structure which tends to produce multidirectional difraction of any waves generated in the water. However, the fibrous strands themselves are not water absorbent; thus, the fibrous member is easily evacuated of water when it becomes necessary to drain the waterbed. The attachment of the fibrous member to the foam provides a means for spacial orientation of the dampening apparatus within the waterbed since the foam is extremely buoyant and remains in touching contact with the upper surface of the bladder.

Accordingly, the primary object of the present invention is to provide a fibrous wave-dampening apparatus for use in a waterbed mattress.

It is a further object of the invention to provide a fibrous wave-dampening apparatus with an attached foam member.

It is a further object of the present invention to provide a fibrous wave-dampening apparatus which will not retain water during drainage of a waterbed.

It is a further object of the present invention to provide a fibrous wave-dampening apparatus which will not generate a substantial vertical force when it is compressed by a waterbed user.

It is a further object of the present invention to provide a fibrous wave-dampening apparatus which is not physically attached to the walls of the waterbed.

It is a further object of the present invention to provide a fibrous wave-dampening apparatus which utilizes a foam member as an orientation means.

It is a further object of the present invention to provide a fibrous wave-dampening apparatus which may be fabricated in a variety of sizes and shapes.

It is a further object of the present invention to provide a fibrous wave-dampening apparatus which utilizes a foam member as a padding against shocks.

It is a further object of the present invention to provide a fibrous wave-dampening apparatus which may be compressed into a small volume by a vacuum means.

It is a further object of the present invention to provide a fibrous wave-dampening apparatus which is inexpensive to fabricate and produce.

It is a further object of the present invention to provide a fibrous wave-dampening apparatus wherein foam from a foam member penetrates into the surface of a fibrous member to provide attachment thereto and to prevent the material from bunching up.

It is a further object of the present invention to provide a fibrous wave-dampening apparatus which may be used compatibly with conventional waterbed accessories.

It is a further object of the present invention to provide a fibrous wave-dampening apparatus which uses open celled foam.

It is a further object of the present invention to provide a fibrous wave-dampening apparatus which uses closed celled foam.

DESCRIPTION OF THE PREFERRED EMBODIMENTS

Figure 2:
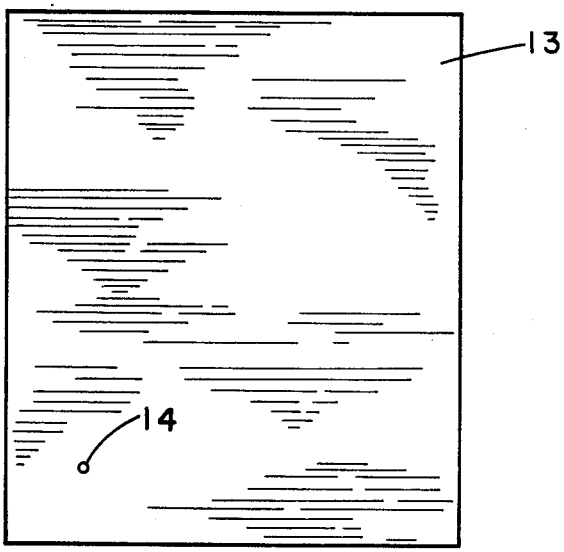
FIG. 2 is a top view of a wave-dampening apparatus.
Figure 3:
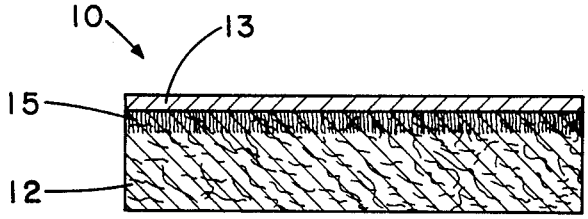
FIG. 3 is a cross-sectional view of the wave-dampening apparatus of FIG. 1.
Figure 4:
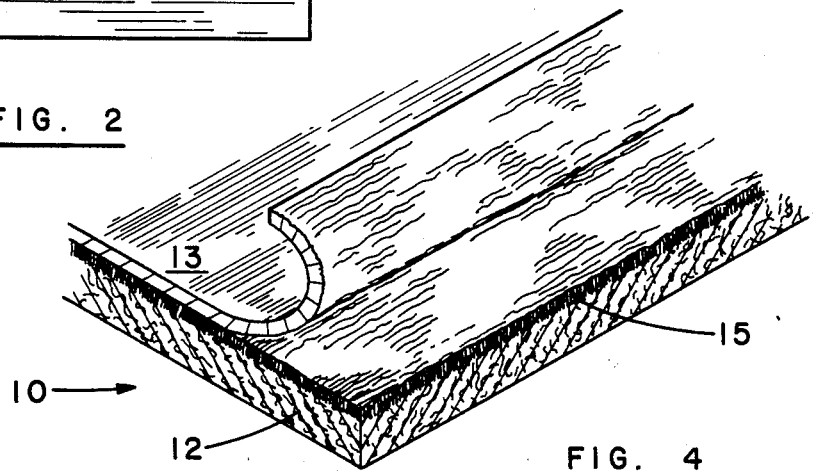
FIG. 4 is a tear-away view of a wave-dampening apparatus.

The structure and materials of the wave-dampening apparatus will now be described. It may be seen from FIGS. 1, 2, and 3 that the wave-dampening apparatus 10 is a parallelopiped, or more colloquially, a box-shaped solid with substantially the same dimensions as the interior dimensions of a waterbed bladder 11 into which it is placed. As shown in FIGS. 3 and 4, the dampening apparatus 10 consists of a parallelopiped-shaped fibrous member 12 with a foam sheet 13 attached to its upper surface. In the preferred embodiment, the fibrous member 12 is formed from a resinated bonded fiber. The fiber material is a spun polyester which has been coated with a resin to stabilize the material chemically and to make the fiber strands impervious to water. The foam member 13 of the preferred embodiment is formed from a foam which is spread over the surface of the fibrous member 12 in a liquified form and allowed to cure. While in the liquid form, the foam penetrates into the upper surface of the fibrous member 12 to form a penetration layer 15 which co-acts with the fibrous material to bond the foam member 13 and fibrous member 12 together. The liquified foam may be applied with a high pressure spray gun to increase the penetration of the foam into the fibrous member 12. A flexible polyurethane foam such as that formed from polyol and resin is used in the preferred embodiment, although other foam substances could be applied in a similar manner and are within the scope of the invention. In the preferred embodiment, the foam member 13 is approximately one-half inch in thickness.

The present invention provides wave dampening by filling the water in which wave disturbances are set up with a multiplicity of fibrous strands which refract wave energy in many different directions. The multidirectional wave patterns associated with each strand tend to combine and have a canceling effect on one another, thus allowing wave energy to be quickly dissipated. The advantage of a fibrous dampening apparatus 10 over most other dampening means is that, although wave energy is dissipated, the fluid deformability of the waterbed is not affected. Whereas most dampening means utilize baffles or chambers which tend to separate the waterbed into separate regions and create non-uniform pressure distributions on the sleeping surface, the pressure distributions produced by a mattress using the fibrous dampening apparatus 10 are uniform throughout the bed. Another advantage of the present dampening apparatus 10 has to do with the extremely low load bearing capability of the fibrous member 12. Because the fibrous member 12 is essentially incapable of supporting any weight, it creates no interference with the fluid support provided by the co-action between the waterbed bladder 11 and the water.

The attachment of the foam sheet 13 to the upper surface of the fibrous member 12 allows the apparatus to be properly oriented within the bladder 11 since the foam is extremely buoyant and will orient itself to conform with the upper horizontal surface of the waterbed. The foam penetration of the fibrous member 12 produces a stiffening effect in the fibrous material which helps it to retain its shape. But the nonresonant structure of the fibrous member 12 also produces an effect on the foam sheet 13 causing it to be more resistent to bunching up. Thus, the co-action of the foam sheet 13 with the fibrous member 12 produces an apparatus with properties that are different and superior to those of either material acting by itself.

In the preferred embodiment, the dampening apparatus is sized approximately four inches shorter in both length and width than the waterbed bladder to facilitate the self-orientation of the apparatus and to prevent curling of the edges of the apparatus. A hole 14 provided in the foam member 13 is positioned immediately below an opening in the bladder 11 and thus allows water to be readily passed through the foam member 13 when the waterbed is being inflated or deflated. The penetration bonding of the foam member 13 to the upper surface of the fibrous member 12 assures that two members will not separate. The foam member 13, in addition to providing orientation of the dampening apparatus 10 within the bladder 11 also creates an esthetically pleasing appearance by providing a solid uniform sheet which covers the upper surface of the apparatus 10. A further function of the sheet 13 is to provide cushioning against "bottoming out". "Bottoming out" refers to a person's striking the base and lower surface of a waterbed when most of his weight is applied to a single small area of the bed. Since the foam member 13 is positioned at the top of the dampening apparatus 10, it does not provide vertical support nor otherwise interfere with the fluid "feel" of the bed until the bladder 11 is so deformed that the upper surface and the lower surface of the bladder 11 are close to contacting each other. Thus, cushioning is provided only when required without affecting the desirable sleeping characteristics of the waterbed.

Figure 1:
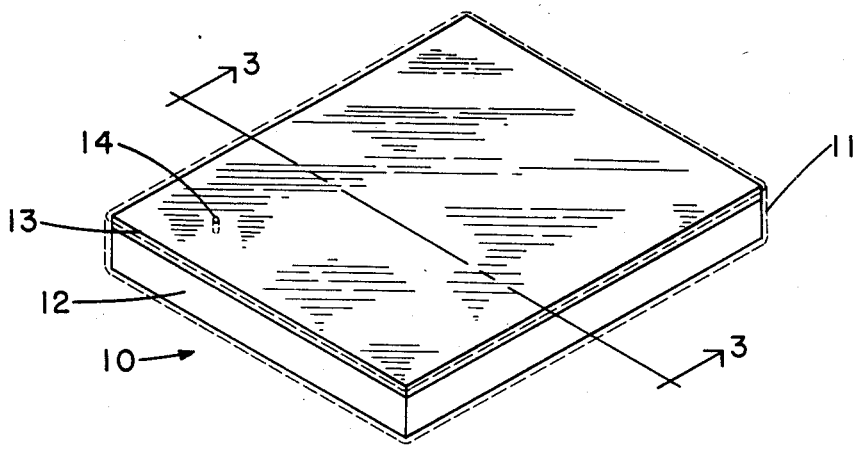
FIG. 1 is a perspective view showing a wave-dampening apparatus within a waterbed bladder.
Figure 5:
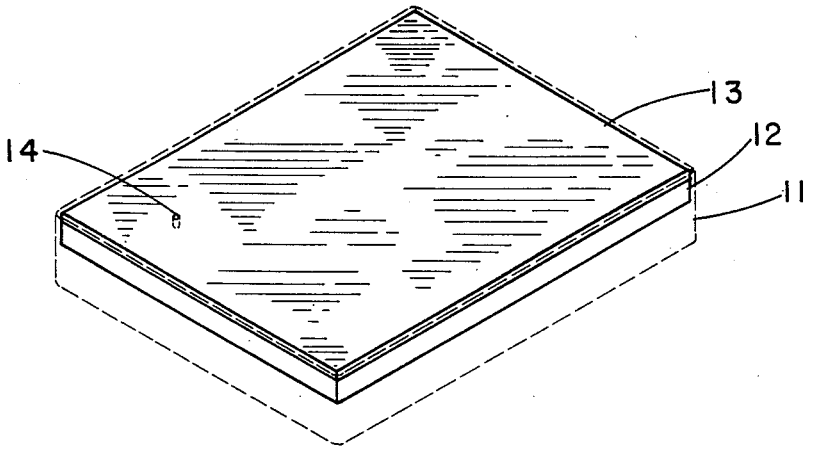
FIG. 5 is an alternate view of a wave-dampening apparatus within a waterbed bladder.

For maximum dampening effect, the entire interior of the bladder 11 may be filled with the dampening apparatus 10 as shown in FIG. 1. In another embodiment of the invention, as shown in FIG. 5, the fibrous member 12 has a depth substantially less than that of the bladder 11 and the entire dampening apparatus 10 floats in the upper portion of the bladder 11. This embodiment provides maximum fluid "feel" because no surface of the dampening apparatus 10 is in contact with the lower surface of the bladder 11, and thus no support forces are felt by the sleeper except as produced by the co-action of the water and the bladder 11.

Figure 6:
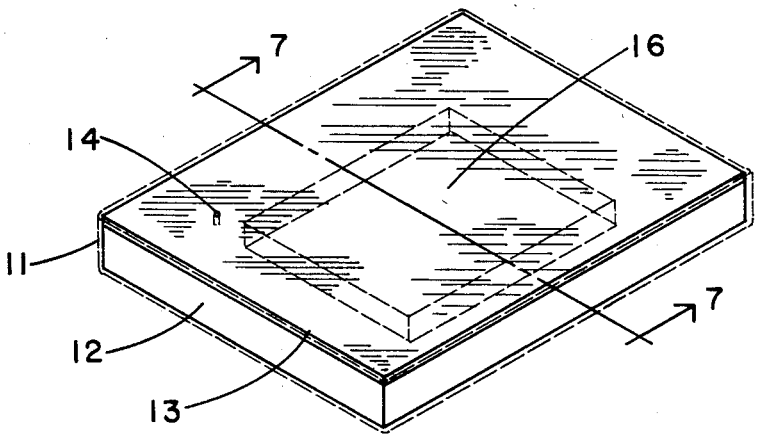
FIG. 6 is another alternate view of a wave-dampening apparatus within a waterbed bladder.
Figure 7:
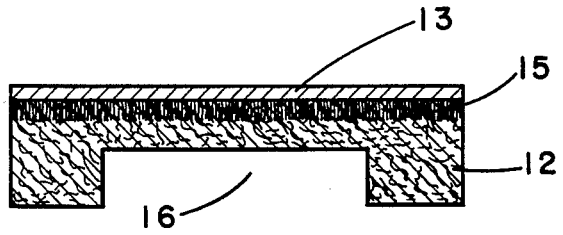
FIG. 7 is a cross-sectional view of the wave-dampening apparatus of FIG. 6.

FIGS. 6 and 7 show another embodiment of the invention in which a parallelopiped cutout 16 has been removed from the central portion of the fibrous member 12. In this embodiment, maximum dampening is produced along the lateral walls of the waterbed where the refracted waves and annoying slapping noises associated with the waves are produced. The cutout portion 16 increases the fluid "feel" in an area where a person is likely to sleep. Many other cutouts and configurations of either the fibrous member 12 or the foam member 13 may, of course, be produced and are within the scope of the present invention. Thus, it can be seen that a wave-dampening apparatus 10 has been provided which allows a waterbed to retain all of the desirable sleeping characteristics generally associated with waterbeds while, at the same time, providing efficient wave dampening. The dampening apparatus 10 provided is extremely light and does not retain water; therefore, the bed may be easily drained and stored. A vacuum apparatus may be attached to the opening in the bladder 11 to evacuate air and facilitate initial compression and packaging of the waterbed.

Although specific components and steps have been stated in the above description of the preferred embodiments of the invention, other suitable materials, and process steps may be used with satisfactory results with varying degrees of quality. In addition, it will be understood that various other changes of the nature of the invention will occur to and may be made by those skilled in the art, upon the reading of this disclosure. Such changes are intended to be included within the principles and scope of this invention as claimed.

I claim:

1. In combination with a waterbed mattress bladder, a wave-dampening apparatus, comprising a flexible fibrous member positioned within and filling a substantial portion of the waterbed mattress bladder, said fibrous member having an upper surface and a lower surface and a foam member comprising a flexible sheet of a buoyant foam material, said foam member being operably attached to said upper surface of said fibrous member by foam penetration of said fibrous member by said foam member, said foam member substantially covering the upper surface of said fibrous member, the horizontal dimensions of said wave-dampening apparatus being similar to but less than the horizontal dimensions of the mattress bladder whereby the buoyancy of said foam member tends to maintain the orientation of said dampening apparatus relative to said bladder.

2. The combination of claim 1 wherein the upper surface of said wave-dampening apparatus is substantially a mirror image of the upper interior surface of the waterbed mattress bladder.

3. The combination of claim 1 wherein said wave-dampening apparatus has a substantially parallelopiped shape.

* * * * *